US005868046A

United States Patent [19]

Eddy

[11] Patent Number: 5,868,046

[45] Date of Patent: Feb. 9, 1999

[54] ADJUSTABLE STRAP WRENCH

[76] Inventor: Ray Nelson Eddy, 38 Callahan Dr., Crawfordville, Fla. 32327

[21] Appl. No.: 700,563

[22] Filed: Aug. 8, 1996

[51] Int. Cl.[6] ..... B25B 13/52

[52] U.S. Cl. ..... 81/65; 81/3.43

[58] Field of Search ..... 81/3.43, 64–65, 81/65.2, 65.4, 68–70

[56] References Cited

U.S. PATENT DOCUMENTS

| | | | |
|---|---|---|---|
| 896,696 | 8/1908 | Lind | 81/65 |
| 1,024,167 | 4/1912 | Whitcomb | 81/65.2 |
| 1,512,014 | 10/1924 | Bryar | 81/65 |
| 1,670,583 | 5/1928 | Lawrence | 81/3.43 |
| 2,771,802 | 11/1956 | Lewis | 81/3.43 |
| 4,160,386 | 7/1979 | Jackson et al. | 73/625 |
| 4,552,040 | 11/1985 | Bang | 81/65 |
| 4,598,615 | 7/1986 | Tate | 81/64 |

FOREIGN PATENT DOCUMENTS

| | | | |
|---|---|---|---|
| 405073 | 12/1909 | France | 81/65 |

*Primary Examiner*—D. S. Meislin
*Attorney, Agent, or Firm*—Carnes,Cona & Dixon

[57] ABSTRACT

The present invention provides for an adjustable wrench device which will enable a user to obtain greater torque for easy removal of items, such as oil filter, jar lids, and removing and tightening screws when used with a screw driver. The adjustable wrench device comprises having a front end and a back end. A threaded rod extends outwardly from the front end and a first clamp is removably secured to the threaded rod. A second clamp is secured to the hand and is located in proximity to the front end. This second clamp cannot be remove from the handle, but it can freely rotate about the handle. A first end of a strap is secured to the first clamp while a second end of the strap is secured to a pivotal level. The pivotal level is secured to the second clamp. Thereby, this design will enable the user to threadably secure the first clamp to the threaded rod for a desired diameter. Once the desired diameter is obtained, the strap is placed around the item and the handle is rotated. This will provided for the pivotal level to rotate to inherently cause the diameter to decrease in size for allowing the strap to securely tighten and engage around the item for easy removal.

14 Claims, 3 Drawing Sheets

ADJUSTABLE STRAP WRENCH

BACKGROUND OF THE INVENTION

1. Field of the Invention

The present invention relates generally to a wrench device and more particularly to an adjustable wrench device which will enable a user to obtain greater torque for easy removal of items such as oil filters, jar lids, removing and tightening screws when used with screw drivers, or the like.

2. Description of the Prior Art

Various type of devices have been employed to enable an individual to remove items, such as oil filters, jar lids, wrenches or the like. These devices are designed and configured so as to render more torque when the device is utilized.

Such a device is disclosed in U.S. Pat. No. 4,598,615, wherein there is disclosed an adjustable wrench. This wrench includes a lever that is pivotally secured to a circular flexible body. An activation means is adapted to be removably secured to the level. This wrench is designed to encompass an oil filter or the like so that once attach, the wrench is in an opened position. Upon turning the activation means, the level will rotate, inherently causing the circular body to decrease in diameter and tightly engage the oil filter or the like. This will provide for the device to be in a second position. Though this device is successful in providing adequate torque for removing a particular item, this device cannot be used with items of varied diameter. Causing a limited utility for the device.

Yet another device is disclosed in U.S. Pat. No. 2,771,802 which includes a screw cap wrench having a flexible strap. This device includes a lever having a reversely turned portion and a transverse portion. The strap is secured to the lever. This will provide for the user to secure the strap around the lid of a jar or the like. The lever is turned to enable the strap to securely engage the lid, enabling the removal. This device is efficient in removing lids from jars, however, this device can only be used with lids of a certain size. The strap cannot be adjusted to accommodate various sized items.

None of these previous efforts provide the benefits intended with the present invention, such as providing a device which will conform to any size oil filter, jar, handles, or the like. Additionally, prior techniques do not suggest the present inventive combination of component elements as disclosed and claimed herein. The present invention achieves its intended purposes, objectives and advantages over the prior art device through a new, useful and unobvious combination of component elements, which is simple to use, with the utilization of a minimum number of functioning parts, at a reasonable cost to manufacture, assemble, test and by employing only readily available material.

SUMMARY OF THE INVENTION

The present invention provides for an adjustable wrench which can be used for providing additional torque for effortless removal of items such as oil filters, jar lids, removing or tightening screws when used with a screw driver, or the like.

The adjustable wrench of the present invention includes a lever or handle having a back end and a front end. Extending outwardly from the front end is a threaded rod. A first clamp is adapted to be threadably secured to the threaded rod. A second clamp is secured to the front end of the lever. This second clamp may rotate about the lever, but cannot be removed thereto. A strap is secured to the first clamp and the second clamp. This design and configuration will enable the user to threadably secure the first clamp to the threaded rod for a desired diameter. Once the desired diameter is obtained, the strap is then placed around the item and the lever is rotated. This will provide for the diameter to decrease in size and inherently cause the strap to securely tighten and engage around the item for easy removal and rotation.

In an alternative embodiment, the strap includes an adjusting means. This adjusting means will enable the strap to be lengthened or shortened for enabling the device to be used on any sized item.

Accordingly, it is an object of the present invention to provide for an adjustable wrench which will overcome the decencies, disadvantages, and shortcomings of convention adjustable wrench and methods thereof.

It is another object of the present invention to provide for an adjustable wrench which can be used on a plurality of items of varied diameters.

Still another object of the present invention is to provide an adjustable wrench whereby twisting torque is greatly increased so that additional leverage is gained for dislodging a work piece.

A final object of the present invention, to be specifically enumerated herein, is to provide an adjustable wrench in accordance with the preceding objects and which will conform to conventional forms of manufacture, be of simple construction and easy to use so as to provide a device that would be economically feasible, long lasting and relatively trouble free in operation.

Although there have been many inventions related to adjustable wrenches, none of the inventions have become sufficiently compact, low cost, and reliable enough to become commonly used. The present invention meets the requirements of the simplified design, compact size, low initial cost, low operating cost, ease of installation and maintainability, and minimal amount of training to successfully employ the invention.

The foregoing has outlined some of the more pertinent objects of the invention. These objects should be construed to be merely illustrative of some of the more prominent features and application of the intended invention. Many other beneficial results can be obtained by applying the disclosed invention in a different manner or modifying the invention within the scope of the disclosure. Accordingly, a fuller understanding of the invention may be had by referring to the detailed description of the preferred embodiments in addition to the scope of the invention defined by the claims taken in conjunction with the accompanying drawings.

BRIEF DESCRIPTION OF THE DRAWINGS

Similar reference numerals refer to similar parts throughout the several views of the drawings.

DESCRIPTION OF THE PREFERRED EMBODIMENTS

Figure 1A:
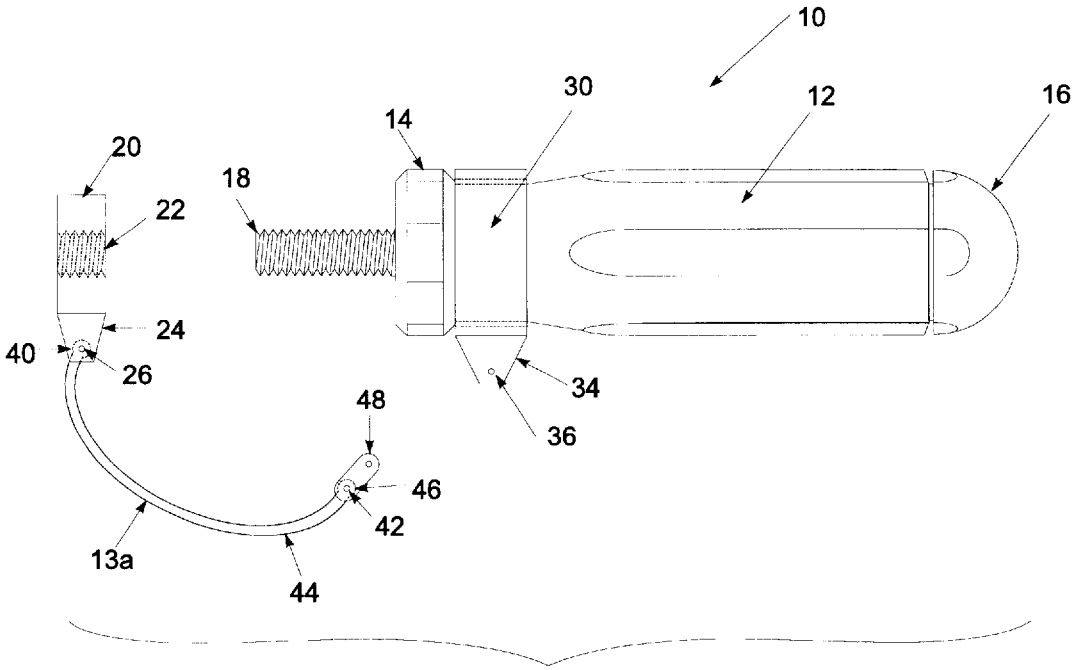
FIG. 1A is a side plan view of the first embodiment of the adjustable wrench of the present invention.
Figure 1B:
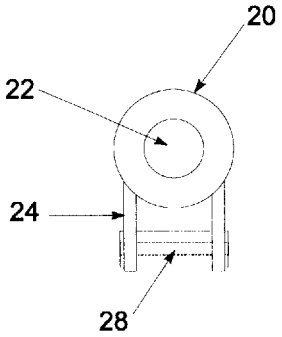
FIG. 1B is a front plan view of the clamp used in the first embodiment of the adjustable wrench of the present invention.
Figure 1C:
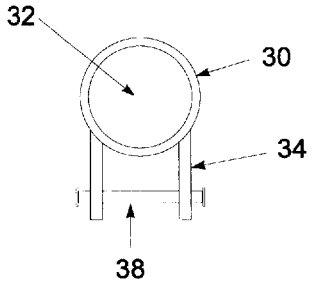
FIG. 1C is a front plan view of the second clamp used in the first embodiment of the adjustable wrench of the present invention.

FIGS. 1A–1C illustrate the first embodiment of the adjustable wrench of the present invention. As seen in these drawings, the adjustable wrench 10 includes a lever or handle 12 and a strap 13. The lever or handle 12 includes a front end 14 and a back end 16. The handle 12 is designed and configured so as to provide a comfortable fit for the user.

Extending outwardly from the front end 14 of the lever or handle 12 is a male threaded portion 18. This male portion 18 is adapted to receive a first clamp 20. The side view of the first clamp is illustrated in FIG. 1A while the front view of the first clamp is illustrated in FIG. 1B.

This first clamp 20 includes a centrally located aperture 22 which is internally threaded. This will provide for the first clamp 20 to be removably and threadably secured to the male portion 18. Extending downwardly and outwardly from the first clamp 20 is a pair of flanges 24. Each flange includes a through hole 26 that is adapted to receive a securing means 28, such as a pin 38. The strap 13*a* is secured to the first clamp 20 via the securing means 28.

A second clamp 30 is secured to the handle 12 in the proximity of the front end 14. The side view of the second clamp is illustrated in FIG. 1A while the front view is illustrated in FIG. 1C. This clamp is secured such that it is not able to be removed, however it can rotate freely about the handle 12. This second clamp is similar in design and structure as with the first clamp. As seen, this second clamp 30 includes a central aperture 32. This central aperture receives the handle 12. Extending outwardly and downwardly from the second clamp 30 is a pair of flanges 34. Each flange 34 includes an aperture 36 for receiving a securing means, such as a pin 38 as illustrated. The strap 13*a* is secured to this second clamp 30 by way of a pivotal lever 48.

The strap 13*a* is fabricated from a semi-flexible sturdy material, such as leather, metal, plastic, or the like. This strap 13*a* includes a first end 40, a second end 42 and an intermediate portion 44 located therebetween. Each end includes an aperture 46. One aperture located at a first end will receive the securing means of the first clamp and the second aperture located at a second end will receive the pivotal lever 48, respectively. The ends of the strap 13 may merely be turned back on itself, so as to form a horizontal channel or aperture 46, while inherently reinforcing the strap. The first end 40 and second end 42 of the strap 13*a* may be fixedly secured to the first clamp and pivotal lever 48, respectively. Optionally, the first end 40 and second end 42 of the strap may be removably secured to the first clamp and pivotal lever, respectively by way of the securing means 28.

This pivot lever 48 includes opposite ends. A first end 42 is secured to the second end of the strap 13*a,* while the second end of the pivotal lever is secured to the second clamp 30 by way of a securing means, such as a pin 38. This pivot lever is designed and configured to enable the lever to pivot and cause the strap to decrease in size so as to render a better gripping means on the particular item.

To use the first embodiment of the adjustable wrench of the present invention, the first clamp 20 is secured and adjusted onto the male portion 18 in order to obtain the desired diameter needed for the item to be engaged. Once the desired diameter is obtained, the device 10 is secured to the item. Readjustments may be made by way of the first clamp with respect to the threaded male portion. The lever 12 is turned to provide for the pivot lever 48 to pivot and cause the diameter of the strap to decrease. This will render the strap 13*a* to tightly engage the item. The handle 12 is rotated to force the strap to rotate the item. The rotation of the handle 12 is continued until the item is loosen or a desired degree.

For better gripping the above described strap can include material having a high coefficient of friction. This will provide for a material which is highly resistive to movement. The material will contact the desired item to be removed to fixedly secure the strap to the item.

The above-describe embodiment can be altered to provide for the adjustable wrench to be utilized with items that include a variety of diameters. This alteration is illustrated in further detail in FIGS. 2A–2E, the second embodiment of the present invention.

As seen in these figures, the adjustable wrench 10 includes a lever or handle 12 and strap 13*b*. The lever or handle 12 is similar in design as illustrated and discussed in first embodiment illustrated in FIGS. 1A–1C, and as such this handle includes a male threaded portion 18 located at the front end which is adapted to receive a first clamp 20.

Figure 2A:
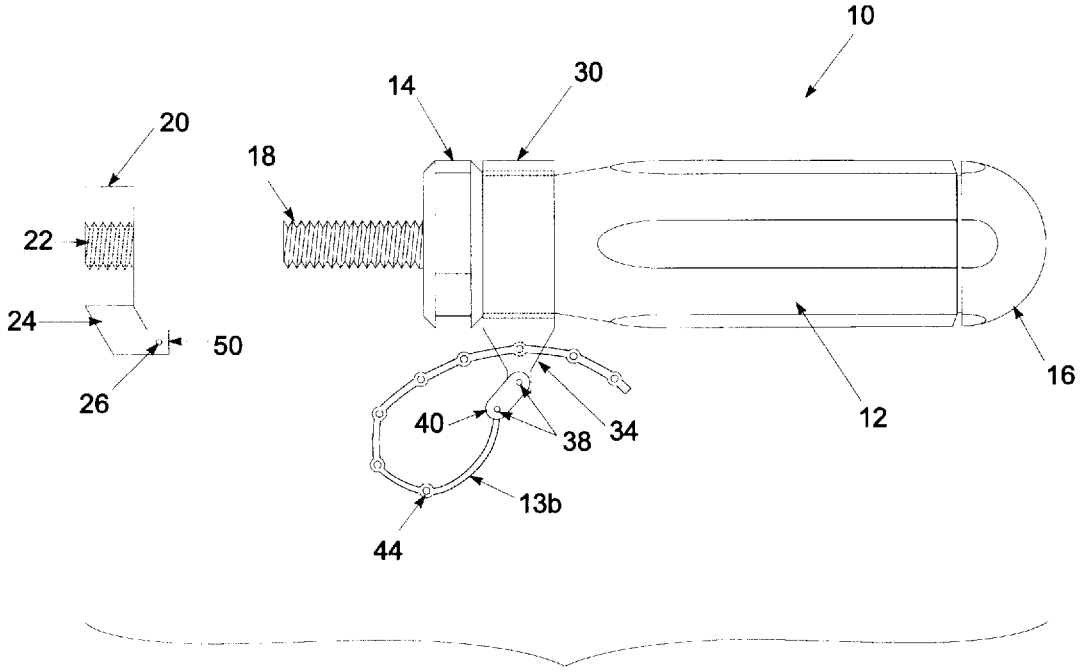
FIG. 2A is a side plan view of the second embodiment of the adjustable wrench of the present invention.
Figure 2B:
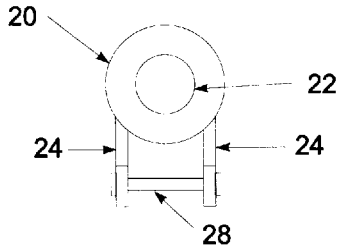
FIG. 2B is a front plan view of the clamp used in the second embodiment of the adjustable wrench of the present invention.
Figure 2C:
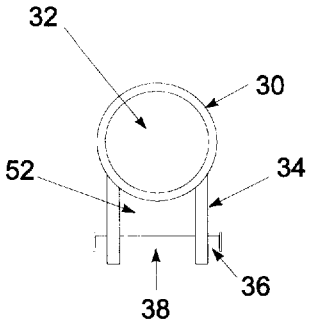
FIG. 2C is a front plan view of a second clamp used in the second embodiment of the adjustable wrench of the present invention.
Figure 2D:
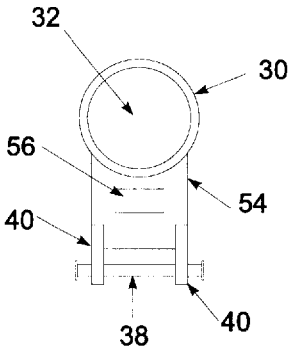
FIG. 2D is a front plan view of a second embodiment for the second clamp used in the adjustable wrench of the present invention.
Figure 2E:
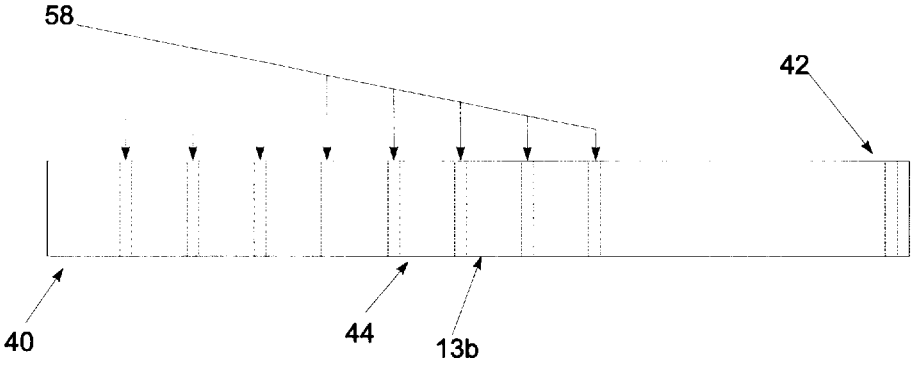
FIG. 2E is a front plan view of the strap used for the second embodiment of the adjustable wrench of the present invention.

The strap 13*b,* as seen in FIGS. 2A and 2E, includes opposite ends 40 and 42, respectively, wherein one end is adapted to be secured to the first clamp 20 and the opposite end is secured to a pivot lever 48. This pivot lever 48 is sandwiched between the strap 13*b* and the second clamp 30. The first and second clamps are similar in design and configuration as the first embodiment. Accordingly, the first clamp 20 and the second clamp 30 each includes a central aperture 22 and 32, flanges 24 and 34 having holes 26, and a securing means, such as a pin 38, is adapted to be received in each hole for securing an end of the strap 13*b* and an end of the pivot lever 48, respectively.

The first clamp 20 further includes an extension 50 which extends outwardly from the flange (see FIG. 2A). This extension maintains the hole 26.

The second clamp 30 can include two embodiments. The first embodiment is illustrated in FIG. 2C and the second embodiment is illustrated in FIG. 2D. As seen in the first embodiment, the second clamp receives the first end of the strap via a gap 52 that is located above apertures 36 of the flange 34. Optionally, as seen in the second embodiment illustrated in FIG. 2D, the gap can be filled with a solid piece of material 54. An opening 56 can extend horizontally therethrough. This opening 56 will act as a guide for the first end 40 of the strap 13*b*.

The strap 13*b,* as seen in FIGS. 2A and FIG. 2E, is designed and configured so as to enable the device 10 of this embodiment to be utilized for a variety of situations. Hence, providing for a strap which is adjustable in length. Accordingly, this tool 10 can be used in combination with a screw driver in order to loosen or tighten a screw. This same tool can have the strap adjusted so as to enable the device to be used to remove a lid from a 16 ounce wide mouth jar, as well as be adapted to remove a conventional oil filter from a vehicle.

This strap 13*b* includes a first end 40, a second end 42, and an intermediate portion 44. The intermediate portion includes a plurality of evenly spaced horizontally spaced channels or apertures 58. The first end and second end also include a horizontally spaced channel or aperture. These channels or apertures 58, located in the intermediate portion, are similar in size and shape to the apertures located on the opposite ends of the strap 13*b*. These apertures are adapted to receive the securing means 28 of the first clamp 20.

This embodiment will require two alterations for adjusting the wrench on the particular item. The first alteration is made to secure the first clamp to the threaded male portion 18. Once secured on the male portion 18, the strap 13*b* is adjusted to encompass the particular item. For adjusting the strap 13*b*, the securing means 28 from the first clamp 20 is removed. The first end of the strap is pulled through the gap 52 or opening 54 of the second clamp 30. Once the desired diameter is achieved, the securing means 28 is inserted into the openings 26 and through apertures 58 for providing the strap to be in a fixed position. The extension 50 aids in the insertion of the securing means 28 for aperture 26. Once fixed, the handle 12 is turned for providing the lever 48 to pivot and tighten around the particular item, inherently loosening the item.

The above described strap can be smooth, as illustrated in the first embodiment, or can optionally include a gripping means. This gripping means can be rubberized strips internally secured to the strap or extenders, as illustrated in these figures. These extenders are formed from the apertures of the strap 13*b*. This non-planar and non-smooth surface will provide for only a portion of the internal surface of the strap to contact the exterior of the item. Since a smaller surface area will be contacting the item, an increase in the average shear stress will occur once force is applied. This increase will provide an increase in the resistance of movement of the strap with respect to the item, inherently causing a better gripping means to occur for enabling the item to be rotated.

For enabling the first embodiment, illustrated in FIGS. 1A–1C, to be adapted to accept any size item, the pivotal levers 48 can be altered in size. This will provide for a device which can be utilized with any size item, from a screw to a lid on a large jar.

To render such an alteration, this embodiment provides that the pivotal lever 48 includes a plurality of sizes that are interchangeable. These pivotal levers come in a variety of sizes and each lever is not separately illustrated in detail in that they are identical in design to the pivotal lever 48 illustrated in FIG. 1A, except that the pivotal levers are typically shorter or longer in length. The variety of sizes are used to accommodate various sized items. This will permit the user to quickly removably attach the pivotal lever to accommodate the specific size item.

The pivotal lever includes opposite ends. Located at each end is an aperture which is adapted to receive a securing means 28, such as a pin. This will provide for the pivotal lever 48 to be removably secured to the second clamp and to the strap via the aperture and securing means.

Accordingly, in order to utilize this device, the user first selects the appropriate size pivotal lever and secures it to the second clamp and strap, respectively. Once secured, the strap is wrapped around the item and the first clamp is threadably affixed to the male portion. The handle is rotate to provide for the lever to pivot upwards and to inherently decrease the diameter of the strap and pivotal lever. This will cause the strap and lever to securely grip to the item. The handle is used to rotate the strap about the item. Upon rotation, the strap will cause the item to be loosened and removed.

While the invention has been particularly shown and described with reference to an embodiment thereof, it will be understood by those skilled in the art that various changes in form and detail may be made without departing from the spirit and scope of the invention.

I claim:

1. An adjustable wrench comprising:

a handle;

a strap;

a receiving portion extends from a front end of said handle;

a first clamp is received on said receiving portion and said first clamp is removably secured to said receiving portion;

a second clamp is secured to said handle in proximity of said front end and said second clamp can rotate freely about said handle;

said strap is secured to said first clamp and said second clamp;

said strap is secured to said second clamp by way of a pivotal lever, said pivotal lever is pivotal secured to said strap and said second clamp; and said receiving portion is threaded, said first clamp includes a centrally threaded aperture and said centrally threaded aperture is removably secured to said receiving portion.

2. An adjustable wrench as in claim 1 wherein said receiving portion is threaded, said first clamp includes a centrally threaded aperture, and said centrally threaded aperture is removably secured to said receiving portion.

3. An adjustable wrench as in claim 1 wherein said strap is removably secured to said first clamp via a securing means.

4. An adjustable wrench as in claim 3 wherein said securing means comprises at least one flange extending downwardly from said first clamp, an aperture extends through said at least one flange, said strap includes a channel, and a pin is removably secured to said aperture and said channel for providing said strap to be removable secured to said first clamp.

5. An adjustable wrench as in claim 1 wherein said pivotal lever is removably secured to said strap and said second clamp via a securing means.

6. An adjustable wrench as in claim 5 wherein said pivotal lever includes a plurality of levers, each lever being a different size in length for enabling one lever to be removably secured to said strap and said second clamp for adjusting the size of said strap in combination with said pivotal lever to render a device which can be utilized on any size item.

7. An adjustable wrench as in claim 1 wherein said strap is fabricated from a semi-flexible sturdy material.

8. An adjustable wrench as in claim 1 wherein said strap include a first end and a second end secured to said second clamp, an adjusting means is located between said first end and said second end of said strap, and said adjusting means is removably secured to said first clamp via a securing means for enabling the adjustment of size of said strap.

9. An adjustable wrench as in claim 1 wherein said strap include a first end and a second end secured to said pivotal lever, an adjusting means is located between said first end and said second end of said strap, and said adjusting means is removably secured to said first clamp via a securing means for enabling the adjustment of size of said strap.

10. An adjustable wrench comprising:

a handle;

a strap having a first end, a second end and an intermediate portion located between said first end and said second end;

a receiving portion extends from a front end of said handle;

a first clamp is received on said receiving portion and said first clamp is removably secured to said receiving portion;

a second clamp is permanently and rotatably secured to said handle in proximity of said front end and said second clamp can rotate freely about said handle;

a pivotal lever includes a first end and a second end, said first end of said pivotal lever is pivotal secured to said second clamp and said second end of said pivotal lever is pivotal secured to said second end of said strap;

said first end of said strap is secured to first clamp;

said strap is fabricated from a semi-flexible sturdy material;

said strap includes a plurality of evenly spaced channels;

said first clamp includes a receiving means which is adapted to align with one channel of said plurality of channel, and a securing means is removably secured to said one channel and said receiving means for providing a strap which is adjustable in size.

11. An adjustable wrench as in claim 10 wherein said first end of said strap is removably secured to said first clamp via a securing means.

12. An adjustable wrench as in claim 10 wherein said pivotal lever includes a plurality of levers, each lever being a different size in length for enabling one lever to be removably secured to said strap and said second clamp for adjusting the size of said strap in combination with said pivotal lever to render a device which can be utilized on any size item.

13. An adjustable wrench as in claim 10 wherein said strap includes extenders located on an internal surface to provide for said strap to have a non-planar and non-smooth surface, said internal surface will contact and engage an item, and said extenders will increase the resistance of movement of said strap with respect to said item.

14. An adjustable wrench comprising:

a handle;

a strap having a first end, a second end and an intermediate portion located between said first end and said second end;

a receiving portion extends from a front end of said handle;

a first clamp is received on said receiving portion and said first clamp is removably secured to said receiving portion;

a second clamp is permanently and rotatably secured to said handle in proximity of said front end and said second clamp can rotate freely about said handle;

a pivotal lever includes a first end and a second end, said first end of said pivotal lever is pivotal secured to said second clamp and said second end of said pivotal lever is pivotal secured to said second end of said strap;

said first end of said strap is secured to first clamp; and said receiving portion is threaded, said first clamp includes a centrally treaded aperture, and said centrally threaded aperture is removably secured to said receiving portion.

* * * * *